US005676330A

United States Patent [19]

Zhu

[11] Patent Number: 5,676,330

[45] Date of Patent: Oct. 14, 1997

[54] WINDING APPARATUS AND METHOD FOR CONSTRUCTING STEEL RIBBON WOUND LAYERED PRESSURE VESSELS

[75] Inventor: Guo Hui Zhu, Miami, Fla.

[73] Assignee: International Pressure Vessel, Inc., Miami, Fla.

[21] Appl. No.: 562,261

[22] Filed: Nov. 22, 1995

[30] Foreign Application Priority Data

Nov. 27, 1994 [CN] China ..... 207228

[51] Int. Cl.[6] ..... B21D 51/24

[52] U.S. Cl. ..... 242/444; 242/447.1; 242/447.3; 242/448.1; 29/429; 220/588

[58] Field of Search ..... 242/438, 447, 242/447.1, 448.1, 448, 436, 444; 220/588; 29/429

[56] References Cited

U.S. PATENT DOCUMENTS

| | | | |
|---|---|---|---|
| 2,011,463 | 8/1935 | Vianini | 252/444 |
| 2,326,176 | 8/1943 | Schierenbeck | 220/3 |
| 2,371,107 | 3/1945 | Mapes | 242/436 |
| 2,405,446 | 8/1946 | Perrault | 242/11 |
| 2,657,866 | 11/1953 | Lungstrom | 242/11 |
| 2,822,825 | 2/1958 | Enderlein et al. | 138/64 |
| 2,822,989 | 2/1958 | Hubbard et al. | 242/438 |
| 3,174,388 | 3/1965 | Gaubatz | 242/444 |
| 3,221,401 | 12/1965 | Scott et al. | 242/436 |
| 3,483,054 | 12/1969 | Bastone | 242/444 |
| 3,504,820 | 4/1970 | Barthel | 220/588 |
| 4,010,864 | 3/1977 | Pimshtein et al. | 220/3 |
| 4,010,906 | 3/1977 | Kaminsky et al. | 242/444 |
| 4,058,278 | 11/1977 | Denoor et al. | 242/7.22 |
| 4,160,312 | 7/1979 | Nyssen | 29/429 |
| 4,262,771 | 4/1981 | West | 242/7.22 |
| 4,429,654 | 2/1984 | Smith, Sr. | 114/65 |
| 4,809,918 | 3/1989 | Lapp | 242/7.22 |
| 4,856,720 | 8/1989 | Deregibus | 242/7.02 |
| 5,046,558 | 9/1991 | Koster | 166/243 |
| 5,346,149 | 9/1994 | Cobb | 242/7.22 |

*Primary Examiner*—Katherine Matecki
*Attorney, Agent, or Firm*—Oltman, Flynn & Kubler

[57] ABSTRACT

An apparatus for winding steel ribbon around a vessel inner shell having forward and rearward ends to construct a pressure vessel includes a vessel support and rotation mechanism, a vessel elevation adjusting mechanism, tracks for supporting and guiding the vessel support and rotation mechanism, a carriage having rail track engaging mechanism for traveling along the track on at least one side of the vessel inner shell, and a ribbon pulling mechanism mounted on the carriage for delivering the ribbon to the vessel inner shell under ribbon tensile loading to pre-stress the vessel. The apparatus preferably additionally includes a locking mechanism for locking the vessel support and rotation mechanism to the track, after the vessel support and rotation mechanism is positioned at forward and rearward ends of a given vessel inner shell. The vessel support and rotation mechanism preferably includes several vessel support roller sets in the form of annular members rotatably mounted on tracks. A method for winding steel ribbon around a vessel inner shell using the above described apparatus, includes the steps of mounting the vessel inner shell on the vessel support and rotation mechanism, securing an end of the ribbon to the vessel inner shell, rotating the vessel inner shell, delivering the ribbon from the ribbon pulling mechanism to the vessel inner shell for winding around the inner shell, and advancing the ribbon pulling mechanism along the track on the carriage to wind the ribbon along the inner shell in a helical path.

17 Claims, 2 Drawing Sheets

WINDING APPARATUS AND METHOD FOR CONSTRUCTING STEEL RIBBON WOUND LAYERED PRESSURE VESSELS

BACKGROUND OF THE INVENTION

1. Field of the Invention

The present invention relates generally to the field of devices for winding steel ribbon around a vessel inner shell to construct a pressure vessel. More specifically the present invention relates to a vessel winding apparatus to be used in conjunction with a portable grinder and a portable welder, and to a method of using the apparatus to construct steel ribbon wound layered pressure vessels.

2. Description of the Prior Art

There have long been steel ribbon winding devices for constructing layered pressure vessels, these vessels generally taking the form of elongate tubular cylinders which are closed at both ends. Conventional winding devices for ribbon wound layered pressure vessels typically include a rotary setup platform to support the vessel inner shell and a pulling assembly for winding the ribbon around the shell under tensile loading.

Existing winding technologies have several deficiencies. One problem is that during the winding operation only a single ribbon, one end of which has been welded to the shell, may be wound on the inner shell at a time. As a result, the pulling force from one side may cause the vessel inner shell to bend and otherwise deform. The unbalanced force can even pull the vessel off the setup platform. Therefore, these devices are not practical for winding large or long vessels. Another problem is that no means are provided on these prior devices to measure and control the tensile force applied to the ribbon during winding. An uneven or unbalanced tensile force on the ribbon significantly compromises the quality and mechanical properties of each steel ribbon and of the final layered shell. Still another problem is that no device or method exists to control the lateral clearance between edges of two adjacent ribbons on each layer. When ribbons overlap, manual adjustments are required to resolve the problem, product quality and production efficiency are low, and automation of the winding operation is thus desirable.

German Patent Application Number 262977, published on Sep. 29, 1977, teaches a vessel secured on an engine lathe-like machine and supported between a spindle on the headstock and a center on the tailstock. A problem with this design is that setting up the vessel inner shell on the machine is difficult and inefficient. Another problem is that this design cannot support very heavy and/or large vessels, such as those weighing a few to several thousand tons during ribbon winding.

The device disclosed in Sehierenbeck, J., Jr., U.S. Pat. No. 2,326,176, issued in August of 1943, makes no provision for pre-bending of the steel ribbon. A problem with omitting the pre-bending step is that it can compromise vessel quality and result in operational problems, because the ribbon may not be laid evenly on the inner shell. Thus typical winding operations require hot winding, rather than cold working, the steel ribbon, making the process more costly. For example, Wickelofen specifies a complex winding method which requires heating shaped ribbons to about 900 degrees Celsius.

Other devices and methods having one or more of the above-identified problems include Enderlein, et al., U.S. Pat. No. 2,822,825, issued on Feb. 11, 1958. Enderlein, et al. discloses an improvement to a metallic hollow body for high pressure service of the type having a core tube with several profiled metal bands spirally wrapped and shrink-stressed on the core tube. The improvement includes at least two adjoining profiled metal bands having a direction of spiral wrapping transverse to each other to provide an opposite torsional stress, each of the adjoining metal bands having their contacting sides profiled for inter-engagement in the direction of spiral wrapping of the outer-most metal band.

Pimshtein, et al., U.S. Pat. No. 4,010,864, issued on Mar. 8, 1977, teaches a multi-layer pressure vessel including a cylindrical portion formed by a pipe with roll strips wound on the pipe and welded to the bottom of the vessel and to its flange for the cover. The roll strips are wound in layers along a helical line so that each subsequent layer is wound in a direction opposite to the preceding layer at a pitch of 0.2 to 2.2 of the inside diameter of the pipe: each layer is constructed with a single strip. The adjacent coils are welded to each other on a helical line only in the roll strip forming the external layer.

Cobb, U.S. Pat. No. 5,346,149, issued on Sep. 13, 1994, reveals an adjustable pipe wrap machine. The Cobb machine is capable of dispensing one or more continuous strips of pipe wrapping material in a constant spiral path around a pipe. The strips overlap one another. Cobb includes mechanisms for simultaneously setting and calibrating the pitch of the spiral path of the machine. The shafts of longitudinally aligned pairs of wheels are interconnected so that each pair of wheels can be simultaneously rotated to a selected angular alignment. Each connecting rod is provided with an indicator and a scale, so that each pair of wheels may be easily rotated to a pre-calibrated position to provide the desired amount of pitch. Each of the wheel shafts extends through a collar mounted on the machine frame.

Koster, U.S. Pat. No. 5,046,558, issued on Sep. 10, 1991, discloses a method and apparatus for repairing casings. Koster includes an improved device and method for creating a lining in a bore, in which a strip wrapped in overlapping spiral fashion about a mandrel is inserted into the bore snugly against the bore wall so that the edge-to-edge relation of the spirally wrapped strip is maintained from the mandrel to the bore wall. Adhesive is applied to the strip surface during wrapping of the strip on the mandrel to secure the lining to the bore wall.

Smith, Sr., U.S. Pat. No. 4,429,654, issued on Feb. 7, 1984, teaches a helical seam structural vessel and construction method and an apparatus for forming the helical seam. Smith, Sr. provides a structural vessel which is double walled, helically wound with a single strip, rib stiffened between walls along helical turns and seam welded along contiguous edges. Smith, Sr. also provides a method of fabrication, including the steps of helically winding one strip of material to form an inner tubular liner, helically winding another strip of material and surrounding the liner in spaced relation to form an outer tubular shell, disposing continuous, helically curved, separate spacers between the liner and the shell, the spacers spanning contiguous edges at successive turns of the liner and spanning contiguous edges at successive turns of the shell, securing the liner edges together and to the spacers, and securing the shell edges together and to the spacers. A floatable work housing is disclosed for vessel fabrication, the housing having a sealed opening through which the completed portion of the vessel progressively extends and is floated on a body of water to avoid a need for external supports and bearings.

Nyssen, U.S. Pat. No. 4,160,312, issued Jul. 10, 1979, discloses a method and apparatus for making multi-layer spiral pipe. Nyssen includes a roll forming device for positioning of two or more sheets in contiguous layers and driving the sheets into a pipe forming device which accepts the sheets and spirals the layers sheets into successive, adjacent helical convolutions having a central axis formed at an oblique angle to the longitudinal axis of the layered sheets. A seaming device in the pipe forming device joins adjacent pipe convolutions.

Denoor, et al., U.S. Pat. No. 4,058,278, issued on Nov. 15, 1977, teaches an apparatus for continuously winding multiple strips under tension onto a conduit. Denoor, et al., includes an apparatus for producing relative rotation of a strip spool around the cylindrical body, a main drive unit for driving the rotation producing means, and means for driving the unwinding of the spool, where the main motor unit simultaneously controls the unwinding of the spool by means of a differential driven by a secondary drive unit constituting the means for braking the spool.

West, U.S. Pat. No. 4,162,771, issued on Jul. 31, 1979, discloses a tensioning device for maintaining proper tension on wire as it is wrapped on concrete pipe. The device is mounted on a carriage which moves horizontally in a direction parallel to the axis of the pipe being wrapped, and feeds wire onto the outer surface of the pipe as the pipe is rotated. At the same time the tensioning device moves parallel to the pipe so as to produce a helical wrap of the pipe. The tensioner includes a frame mounted on the moving carriage.

Lungstrom, U.S. Pat. No. 2,657,866, issued on Nov. 3, 1953, teaches a uniform tension maintaining device for wrapping flexible strip material which is fed from a single reel or simultaneously from two reels, on an elongated object, such as an elongated pipe line. During the spiral wrapping of the strip the device maintains a uniform tension on the unwound portion of the strip, using a ring type power-driven sprocket.

Perrault, U.S. Pat. No. 2,405,446, issued on Aug. 6, 1946, reveals a roll supporting device. Perrault includes a frame member on which is mounted a supply tank above a pipe line to be wrapped, an auxiliary or overflow tank below the pipe line, and a resiliently mounted collar or wiper disposed to move along with the machine beneath the pipe line. Coating material is deposited on the top of the pipe from the supply tank through a discharge nozzle. An excess coating material wiped from the pipe is flowed into the auxiliary tank. Wrapping material is applied by a wrapping device including generally a gear ring rotatably mounted upon radially disposed rollers and carrying stubs. The gear ring is driven by a gear mounted on a shaft which is connected by suitable driving connection to a motor on the frame.

Deregibus, U.S. Pat. No. 4,856,720, issued on Aug. 15, 1989, reveals a helical winding apparatus and method. The method of fabricating as a continuous whole an extremely elongated hose includes the following steps: rotating a correspondingly elongated cylindrical core by independently driving each of the core ends at a fixed speed with a separate motive mechanism and maintaining the separate motive mechanism in synchronism with each other while supporting the core simultaneously externally at several positions intermediate its ends and applying force axially to the core to tension it. The method further includes the steps of moving, at a constant speed along a path parallel to the core a carrier having a bobbin with a length of rubber tape wound on the bobbin, and feeding the length of tape from the bobbin onto the core, as the core rotates, thereby to form a helix building a hose on the core.

Lapp, U.S. Pat. No. 4,809,918, issued on Mar. 7, 1989, discloses an apparatus for winding wire onto an arbor. Lapp includes a frame having two parallel spaced apart triangular shaped ends, a back plate a bottom plate; a spool holder disposed between the frame ends for holding a spool of wire; a wire straightening device disposed between the frame ends for straightening the wire as it comes off a spool of wire placed on the spool holder; a wire laying apparatus disposed between the frame ends and the three wheels with flanges for helically laying wire from the spool onto the arbor so that the turns of wire are nearly perpendicular to the center line of the arbor; and an arbor engagement device causing the wire winding apparatus to remain in intimate rotational contact with the arbor.

It is thus an object of the present invention to provide an apparatus and method for winding a plurality of steel ribbon in each layer around a pressure vessel inner shell at an angle varying from 15 to 30 degrees, the apparatus being able to reliably support light to very heavy inner shells, weighing on the order of a few to several thousand tons.

It is another object of the present invention to provide such an apparatus and method which improve the ribbon layering quality, balance the pulling forces on the ribbon, and increase operational efficiency, thereby overcoming many of the problems associated with the prior art for winding flat steel ribbons on pressure vessels.

It is additionally an object of the present invention to provide such an apparatus which supports the vessel with support roller sets, the number and locations of roller sets being changeable to accommodate vessels of various sizes and weights.

It is further an object of the present invention to provide such an apparatus and method by which the vessel is wound concurrently from both sides of the vessel, so that two opposing ribbon pulling forces nullify each other and subject the vessel only to radial forces about the vessel rotational axis and axial forces along the axis of rotation.

It is still another object of the present invention to provide such an apparatus which includes a ribbon pulling assembly mounted on a rotary table having two degrees of rotational freedom, so that the pulling assembly can lay steel ribbons on the vessel evenly and at a fixed angle, while controlling the ribbon pulling force and the ribbon pre-bending operation, to significantly improve the quality of the ribbon wound layers.

It is still another object of the present invention to provide such an apparatus which includes an adjacency control mechanism for ensuring a constant lateral clearance between edges of immediately adjacent ribbons on a given layer and thus eliminates ribbon overlapping and the need for manual adjustment of the ribbons, and thereby enables automation of the winding process for increased efficiency.

It is finally an object of the present invention to provide such an apparatus which is relatively simple, reliable, economical, and easy to fabricate, and a method of apparatus use which is easy to understand and perform.

SUMMARY OF THE INVENTION

The present invention accomplishes the above-stated objectives, as well as others, as may be determined by a fair reading and interpretation of the entire specification.

An apparatus is provided for winding flat steel ribbon around a vessel inner shell having forward and rearward ends to construct a pressure vessel, including a vessel support and rotation mechanism, a vessel elevation adjusting mechanism, a track for supporting and guiding the vessel support and rotation mechanism, a carriage having rail track engaging mechanism for traveling along the track on at least one side of the vessel inner shell, and a ribbon pulling mechanism mounted on the carriage for delivering the ribbon to the vessel inner shell under ribbon tensile loading to pre-stress the vessel.

The apparatus preferably additionally includes a locking mechanism for locking the vessel support and rotation mechanism to the track, after the vessel support and rotation mechanism is positioned at forward and rearward ends of a given vessel inner shell. The vessel support and rotation mechanism preferably includes several vessel support roller sets in the form of annular members rotatably mounted on a track. The number of the vessel support roller sets is preferably alterable to support the particular weight and length of a given vessel. The apparatus preferably additionally includes a vessel support roller set fastening mechanism for locking each vessel support roller set to the track after each vessel support roller set is positioned to support a given vessel. A pair of rails supporting one carriage is preferably provided on each side of the vessel, so that each carriage carries one ribbon for winding the vessel simultaneously from opposing sides of the vessel to balance and thereby neutralize laterally linear force on the vessel from tensile loading of the ribbons. The carriage preferably additionally includes several annular roller members rotatably mounted on a roller support structure and positioned to prevent toppling of the carriage during winding with the ribbon. The carriage is preferably controlled by an electric speed adjustment device and actuated by a driving means such as a sprocket and chain mechanism to accommodate the winding requirements of each given vessel. The carriage speed along the track is regulated by the speed adjustment device. The carriage preferably includes a carriage base portion and a rotary table rotatably mounted on the base portion, and a ribbon pre-bending mechanism mounted on the rotary table which rotates up to 30 degrees to meet the requirements of ribbon wound layered vessel design. The ribbon pre-bending mechanism preferably includes a conical roller for bearing against one face of the ribbon, and a spherical roller for bearing against the opposing face of the ribbon to cross-sectionally pre-bend the ribbon into an arch shape. Where the carriage includes a carriage base portion and a rotary table rotatably mounted on the base portion, a ribbon guiding device is preferably mounted on the rotary table and driven by a guiding device drive mechanism, for adjusting and controlling the clearance between two adjacent ribbon edges on a given ribbon wound layer. Where the carriage includes a carriage base portion and a rotary table rotatably mounted on the base portion, a force measurement device is preferably mounted on the rotary table for measuring the tensile force applied to the ribbon as the ribbon passes through a hydraulically controlled ribbon pulling mechanism. Where the carriage includes a carriage base portion and a rotary table rotatably mounted on the base portion, the rotary table is preferably mounted to the carriage with a hinge mounting structure so that the rotary table is free to yaw and pitch relative to the carriage. The vessel support mechanism preferably includes a hydraulic power-driven support platform for adjusting to the elevation of the vessel inner shell, and the support platform preferably includes the track engaging mechanism for traveling along the track. The ribbon pulling mechanism preferably includes several rollers rotatably secured to the rotary table in at least two rows.

A method is also provided for winding flat steel ribbon around a vessel inner shell having forward and rearward ends to construct a pressure vessel, using the above described apparatus, including the steps of mounting the vessel inner shell on the vessel support and rotation mechanism, securing an end of the ribbon to the vessel inner shell, rotating the vessel inner shell, delivering the ribbon from the ribbon pulling mechanism at an angle of 15 to 30 degrees to the vessel inner shell for winding around the inner shell, and advancing the ribbon pulling mechanism along the track on the carriage to wind the ribbon along the inner shell in a helical path. The method preferably includes the additional steps of delivering first and second ribbons from the ribbon pulling mechanism located on each side of the vessel to the vessel inner shell for winding around the inner shell simultaneously to balance lateral forces on the inner shell exerted by the ribbons, and advancing a ribbon pulling mechanism on each side of the inner shell along the track on opposing carriages on each side of the inner shell to wind first and second ribbons along the inner shell in a helical path. The method preferably includes mounting auxiliary devices on the apparatus such that supportive operations including welding, grinding and cleaning at both ends of the vessel can be conveniently applied.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
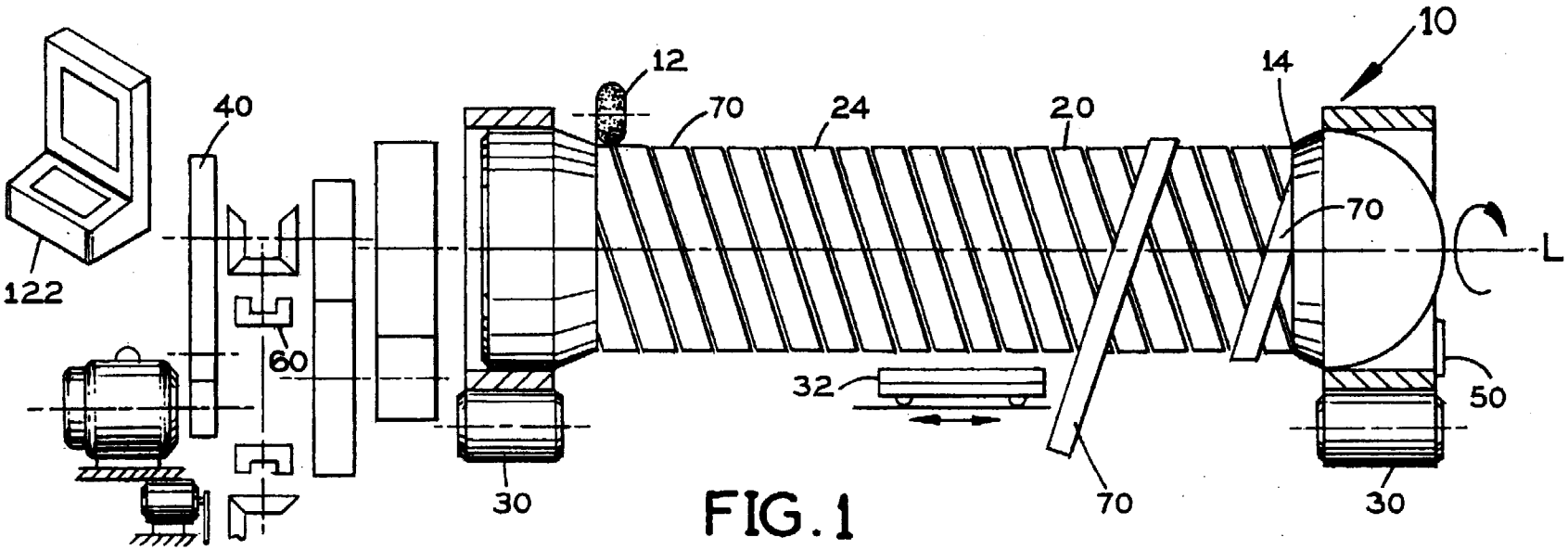
FIG. 1 is a schematic front view of a vessel mounted on the winding apparatus of the first embodiment.
Figure 2:
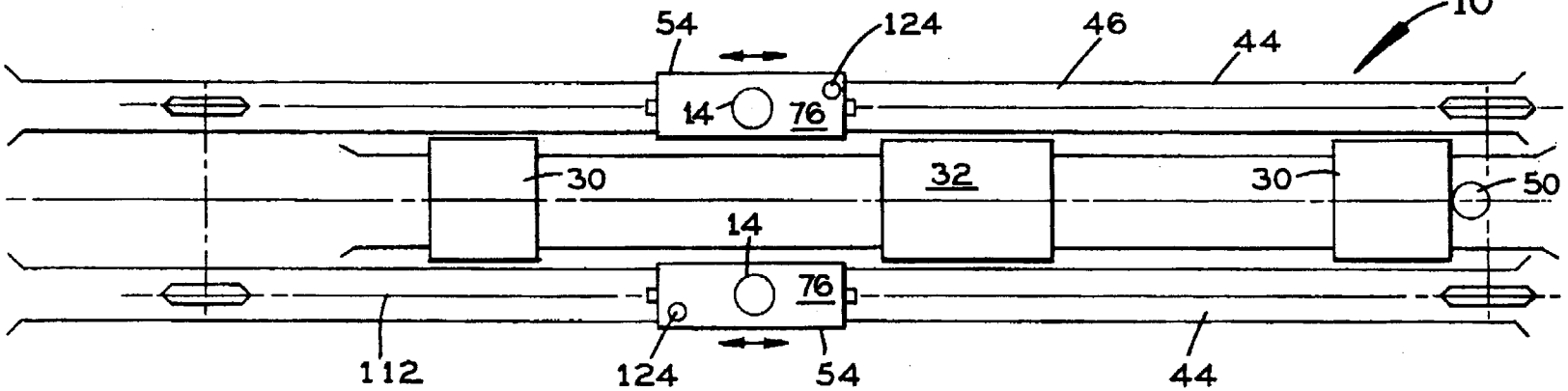
FIG. 2 is a schematic top view of the apparatus of FIG. 1 with the vessel omitted.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiment

Referring to FIGS. 1–6, a pressure vessel winding apparatus 10 is disclosed. Apparatus 10 is adapted for use with a grinder 12 and a welder 14 for construction of ribbon wound layered pressure vessels 20.

As shown in FIG. 1, vessel 20 can be of any vessel design with a thin vessel inner shell 22 and a layered ribbon outer shell 24 of any number of layers. The preferred embodiment of apparatus 10 can wind vessels 20 with an inner diameter at least including those between 1 foot and 13 feet and a length at least including those between 4 and 130 feet. The inner shell 22 thickness may vary at least from 1 to 12 inches. Inner shell 22 of the vessel 20 is rotatably held for winding by support roller sets 30 provided at both ends of vessel 20 and by a speed control mechanism 40. The weight of the vessel 20 is carried by a movable support platform 32.

Vessel 20 is spun about its longitudinal axis L during the winding operation. The spinning of the vessel 20 is actuated by speed control mechanism 40. When a given vessel 20 is very large or very heavy, intermediate roller sets (not shown) in addition to the support roller sets 30 are installed between sets 30. Roller sets 30 extend across and travel along two parallel rails 44 forming a track 46, and are adjustable to give different vessel 20 elevations. Roller sets 30 are fastened to rail track 46 after being suitably positioned along track 46 to support a given vessel 20. The solid support provided by rail track 46 overcomes the traditional limitations on vessel 20 size and weight. Locating roller sets 50 are installed on support roller sets 30 at the rearward end of apparatus 10 and are fastened by a locking means such as an eccentric lever to rail track 46 as well, to confine and balance the radial and axial pulling forces on vessel 20. These structures eliminate the need for a large scale tail stock.

Figure 3:
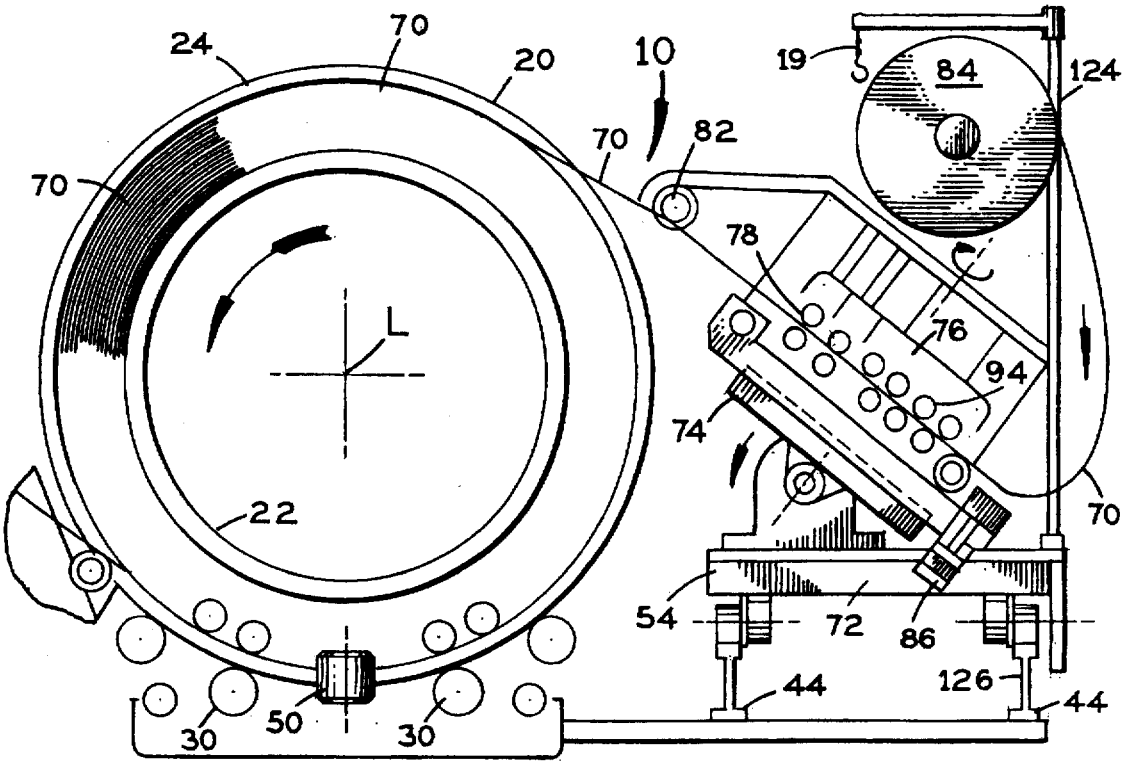
FIG. 3 is an end view of the second embodiment of the apparatus having separate winding device carriage tracks at one side of the vessel and showing a carriage and rotary table, and the ribbon pulling and layering mechanism, the pre-bending device and the force controller mounted on the rotary table.

Roller sets 30 are provided on track 46 to constrain and support the vessel 20. Support platform 32 is a wheeled cart which closely fits and rides between rails 44. An electromagnetic controlled clutch 60 controls the rotation of the vessel 20 and the movement of carriage 54. When clutch 60 is disengaged, the vessel 20 and carriage 54 operate independently. Carriage 54 is operated by an electric speed control mechanism 60, which also serves as a brake mechanism to slow and stop vessel 20 rotation. One to three movable support platforms 32 are used to support a vessel 20 during the winding operation and to transport the vessel 20 after winding. Platforms 32 include means for adjusting the vessel 20 elevation, and move along track 46 to positions required to support a given vessel 20. Platforms 32, actuated by a hydraulic means, eliminate the need for heavy duty plant and bridge cranes, which are typically required for fabricating vessels weighing several hundred or thousand tons. A carriage 54 is preferably located on both sides of the vessels. Roller sets are installed on carriages 54, including anti-toppling roller sets 126 on track 44. Carriages 54 each include a base portion 72 on which a rotary table 74 is mounted. Located on rotary table 74 are a ribbon pulling mechanism 76 for layering the steel ribbon 70 at an angle varying from 15 to 30 degrees, a ribbon pre-bending device 78, a ribbon guiding device 82, a ribbon storage reel 84, and a ribbon tensile force measurement device 86. This structure is shown generally in the FIG. 3 illustration of the second embodiment, and is substantially the same for the first embodiment illustrated in FIGS. 1 and 2 as well. The longitudinal movement of carriage 54 is actuated by a sprocket and chain assembly 112 or pinion and rack assembly (not shown), thereby avoiding the high friction losses associated with lead screw and feed rod mechanisms.

Figure 4:
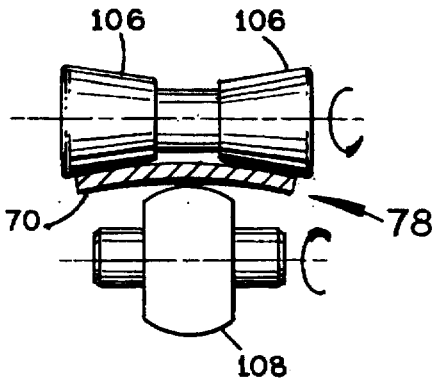
FIG. 4 is a schematic cross-sectional end view of a steel ribbon segment being pre-bent between rollers of the pre-bending device.
Figure 5:
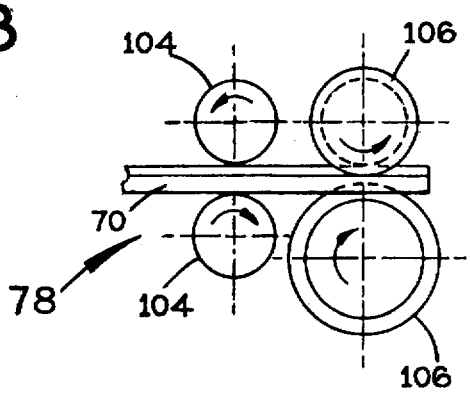
FIG. 5 is a schematic side view of the ribbon segment and pre-bending rollers of FIG. 4.
Figure 6:
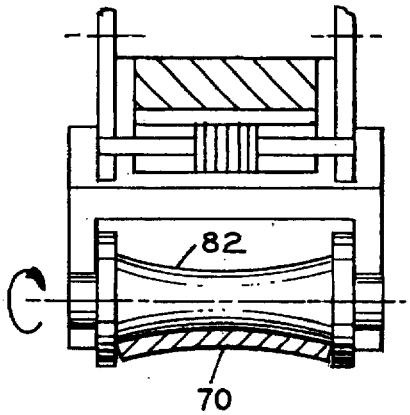
FIG. 6 is a schematic cross-sectional end view of a steel ribbon passing through the ribbon clearance control device.

Pulling mechanism 76 for layering a steel ribbon 70 includes seven to nine rollers 94, preferably each about 2.36 inches in diameter, and preferably three of which are for ribbon 70 pre-bending. The tensile force on ribbon 70 is adjusted by adjusting the pressure between the upper and lower rollers 94 on pulling mechanism 76. The adjustment of tensile force on ribbon 70 is preformed in real time during the winding operation. The ribbon 70 pulling force is measured with force measurement device 86, which preferably takes the form of either a chain and lever assembly or a hydraulic gauge, located on pulling mechanism 76. Pre-bending device 78 is installed at the forward end of pulling mechanism 76. As shown in FIG. 4–6, a pre-bending adjustment device 78 is provided including a cylindrical roller set 104, a pre-bending conic roller 106 and a spherical roller 108. The pre-bending pressure is adjusted to assure a tight fit of ribbon 70 on each vessel 20 layer without causing ribbon 70 distortion, such as a bump and a bulge.

As shown in FIG. 6, a hydraulic or lead screw actuated ribbon guiding device 82 is provided on rotary table 74 for adjusting the winding angle and the clearance between edges of two adjacent ribbons 70. This is a simple but effective technique which makes automation of the winding operation possible. FIGURE 3 shows that rotary table 74 is installed with a chain 112 on the top of carriage 54. A number of auxiliary devices are shown in FIG. 1. At both ends of apparatus 10 are an arc welder 14, a portable grinder 12, a microprocessor and control box 122, and a lifting device 124 for handling the ribbon reel 84.

Method

A method is provided of winding steel ribbon 70 around a vessel inner shell 22 having forward and rearward ends to construct a high pressure vessel 20 using apparatus 10. The method includes the steps of mounting vessel 20 inner shell 22 on vessel support and speed control mechanism 40, securing an end of ribbon 70 to vessel inner shell 22, rotating vessel inner shell 22, delivering ribbon 70 from ribbon pulling mechanism 76 on rotary table 74 to vessel inner shell 22 for winding around inner shell 22, and advancing ribbon pulling mechanism 76 along track 44 on carriage 54 to wind ribbon 70 in along inner shell 22 in a helical path. The method preferably includes the additional steps of delivering first and second ribbons 70 from ribbon pulling mechanism 76 located on each side of vessel inner shell 22 to inner shell 22 for winding around inner shell 22 simultaneously to balance lateral forces on inner shell 22 exerted by ribbons 70, and advancing ribbon pulling mechanism on each side of inner shell 22 along track 44 on opposing carriages 54 on each side of inner shell 22 to wind ribbons 70 along inner shell 22 in a helical path.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for winding steel ribbon around a vessel inner shell having forward and rearward ends to construct a high pressure vessel, comprising:

vessel support and rotation means, vessel elevation adjusting means, track means for supporting said vessel support and rotation means and said vessel during vessel rotation and for supporting and guiding said vessel support and rotation means and said vessel during vessel translational movement along said track means, a carriage having rail track engaging means for traveling along said track means on at least one side of said vessel inner shell, and a ribbon pulling means mounted on said carriage for delivering said ribbon to said vessel inner shell under ribbon tensile loading to pre-stress said vessel.

2. An apparatus according to claim 1, additionally comprising locking means for locking said vessel support and rotation means to said track means, after said vessel support and rotation means are positioned at forward and rearward ends of a given said vessel inner shell.

3. An apparatus according to claim 1, wherein said vessel support and rotation means comprise a plurality of vessel support roller sets in the form of annular members rotatably mounted on track means.

4. An apparatus according to claim 3, wherein the number of said vessel support roller sets is alterable to support the particular weight and length of a given said vessel.

5. An apparatus according to claim 3, additionally comprising vessel support roller set fastening means for locking each said vessel support roller set to said track means after each said vessel support roller set is positioned to support a given said vessel.

6. An apparatus according to claim 1, wherein said carriage additionally comprises a plurality of annular roller members rotatably mounted on rails and positioned to prevent toppling of said carriage during winding with said ribbon.

7. An apparatus according to claim 1, wherein said carriage is controlled by a speed adjustment device and actuated by a transmission mechanism to accommodate various winding requirements of a given vessel.

8. An apparatus according to claim 7, wherein carriage speed along said track means is regulated by said speed adjustment device.

9. An apparatus according to claim 1, wherein said carriage comprises a carriage base portion and a rotary table rotatably mounted on said base portion, and a ribbon guiding device mounted on said rotary table and driven by guiding device drive means, for adjusting and controlling the clearance between two adjacent ribbon edges on a given ribbon wound layer.

10. Art apparatus according to claim 1, wherein said carriage comprises a carriage base portion and a rotary table rotatably mounted on said base portion, a force measurement device mounted on said rotary table for measuring the tensile force applied to said ribbon as said ribbon passes through said ribbon pulling means, and a regulator means coupled to the force measurement device for sending signals therefrom to said ribbon pulling means.

11. An apparatus according to claim 1, wherein said vessel support means comprises a hydraulic power-driven support platform for adjusting to the elevation of said vessel inner shell, and wherein said support platform comprises said track engaging means for traveling along said track means.

12. An apparatus according to claim 1, wherein said ribbon pulling means comprises a plurality of ribbon roller means rotatably secured to said rotary table in at least two rows.

13. An apparatus for winding steel ribbon around a vessel inner shell having forward and rearward ends to construct a high pressure vessel, comprising:

vessel support and rotation means, vessel elevation adjusting means, track means, a carriage having rail track engaging means for traveling along said track means on at least one side of said vessel inner shell, and a ribbon pulling means mounted on said carriage for delivering said ribbon to said vessel inner shell under ribbon tensile loading to pre-stress said vessel, wherein one said track means supporting one said carriage is provided on each side of said vessel, such that each said carriage carries one said ribbon for winding said vessel simultaneously from substantially opposing points along opposing sides of said vessel to balance and thereby neutralize laterally linear force on said vessel from tensile loading of said ribbons.

14. An apparatus for winding steel ribbon around a vessel inner shell having forward and rearward ends to construct a high pressure vessel, comprising:

vessel support and rotation means, vessel elevation adjusting means, track means, a carriage having rail track engaging means for traveling along said track means on at least one side of said vessel inner shell, and a ribbon pulling means mounted on said carriage for delivering said ribbon to said vessel inner shell under ribbon tensile loading to pre-stress said vessel, wherein said carriage comprises a carriage base portion and a rotary table rotatably mounted on said base portion, and a ribbon pre-bending mechanism mounted on said rotary table.

15. An apparatus according to claim 14, wherein said ribbon pre-bending means comprises:

a conical roller for bearing against one face of said ribbon, and a spherical roller for bearing against the opposing face of said ribbon to cross-sectionally pre-bend said ribbon into an arch shape.

16. An apparatus for winding steel ribbon around a vessel inner shell having forward and rearward ends to construct a high pressure vessel, comprising:

vessel support and rotation means, vessel elevation adjusting means, track means, a carriage having rail track engaging means for traveling along said track means on at least one side of said vessel inner shell, and a ribbon pulling means mounted on said carriage for delivering said ribbon to said vessel inner shell under ribbon tensile loading to pre-stress said vessel, wherein said carriage comprises a carriage base portion and a rotary table rotatably mounted on said base portion, and wherein said rotary table is mounted to said carriage with hinge mounting means such that said rotary table is free to yaw and pitch relative to said carriage.

17. A method of winding steel ribbon around a vessel inner shell having forward and rearward ends to construct a pressure vessel, using an apparatus comprising vessel support and rotation means, vessel elevation adjusting means, track means and rotation means, a carriage having rail track engaging means for traveling along said track means on at least one side of said vessel inner shell, and a ribbon pulling means mounted on said carriage for delivering said ribbon to said vessel inner shell under ribbon tensile loading to pre-stress said vessel, comprising the steps of:

mounting said vessel inner shell on said vessel support and rotation means, securing an end of said ribbon to said vessel inner shell, rotating said vessel inner shell, delivering said ribbon from said ribbon pulling means to said vessel inner shell for winding around said inner shell, and advancing said ribbon pulling means along said track means on said carriage to wind said ribbon in along said inner shell in a helical path, delivering first and second said ribbons from two said ribbon pulling means, one said ribbon pulling means being located on each side of said vessel, to said vessel inner shell to wind around said inner shell simultaneously and thereby to balance lateral forces on said inner shell exerted by said ribbons, and advancing said ribbon pulling means on each side of said inner shell along said track means on opposing said carriages on each side of said inner shell to wind said first and second ribbons along said inner shell in a helical path.

* * * * *